US005662223A

United States Patent [19]

Sylegård

[11] Patent Number: 5,662,223

[45] Date of Patent: Sep. 2, 1997

[54] PLASTIC CONTAINER

[75] Inventor: Ingvar Sylegård, Hässleholm, Sweden

[73] Assignee: Perstorp AB, Perstorp, Sweden

[21] Appl. No.: 428,200

[22] PCT Filed: Oct. 22, 1993

[86] PCT No.: PCT/SE93/00862

§ 371 Date: May 2, 1995

§ 102(e) Date: May 2, 1995

[87] PCT Pub. No.: WO94/10053

PCT Pub. Date: May 11, 1994

[30] Foreign Application Priority Data

Nov. 4, 1992 [SE] Sweden ..... 9203254

[51] Int. Cl.[6] ..... B65D 6/02

[52] U.S. Cl. ..... 206/508; 220/1.5

[58] Field of Search ..... 206/507, 508, 206/509; 220/1.5, 495, 625, 356

[56] References Cited

U.S. PATENT DOCUMENTS

| | | | |
|---|---|---|---|
| 3,586,205 | 6/1971 | Van Daalen | 220/508 |
| 4,848,580 | 7/1989 | Wise | 220/508 X |
| 4,936,615 | 6/1990 | Moore | 220/1.5 X |
| 5,253,776 | 10/1993 | Decroix et al. | 220/1.5 X |
| 5,332,114 | 7/1994 | Sano et al. | 206/508 X |

*Primary Examiner*—Steven M. Pollard

*Attorney, Agent, or Firm*—Scully, Scott, Murphy & Presser

[57] ABSTRACT

A plastic container, basket or the like including a box (2) and a lid (1). The box (2) is made up of a base, four walls (32, 33, 34, 35) and an upper rim (21), which rim (21) in the four upper corners (24, 25, 26, 27) of the box is provided with recesses (28) having vertical surfaces (4) arranged so that an angle (31) of less than 135° is formed on the inside of the box between the surfaces (4) and associated walls (32, 33, 34, 35). The lid (1) consists of four sides (12, 13, 14, 15), four corners (5, 6, 7, 8), an upper surface (18), a lower surface (16) and an outer surrounding border. The four corners (5, 6, 7, 8) have vertical surfaces (3) arranged on the lower surface (16) of the lid that cooperate with the vertical surfaces (4) of the recesses in the rim (21) of the box (2).

15 Claims, 8 Drawing Sheets

PLASTIC CONTAINER

BACKGROUND OF THE INVENTION

1. Field of the Invention

The present invention relates to containers; and more specifically, to a plastic, stackable container comprising a lid and a box, wherein the stacking strength of the container, especially of the lid, is considerably increased over that of existing containers.

2. Discussion of the Prior Art

Presently known stackable plastic containers comprising load carrying lids are not suitable for heavy payloads due to their structural design.

Reinforcing means such as webs, ribs, beams, girders and the like, can be placed on or formed as an integral part of the lid. It is, however, impracticable to arrange such reinforcements on the lower horizontal surfaces around the border of the lid because of small contact area between said horizontal surfaces and the upper rim of the box. This results in strength and stability problems that are especially pronounced in the four corners of the lid where up to 80% of the strain caused by weights placed on top of the lid is absorbed. The strain related diagonally inwards and/or downwards directed forces will inevitably bend the inner area of the lid downwards and the four corners upwards, whereby the lid finally will be squeezed down into the box. Such an impact on a lid will pose an obvious and very high risk of lopsidednesses, which finally will overturn a stack of containers.

SUMMARY OF THE INVENTION

Above discussed problems and impediments have through the present invention been solved and a new concept for stackable containers, baskets or the like has been brought about. The container comprises i) a box having a base, four walls and an upper surrounding rim, said rim having recesses located in the four upper corners of the box, said recesses having vertical surfaces arranged so that an angle of less than 135° is formed on the inside of the box between the vertical surfaces and the associated walls; and ii) a lid having four sides, an upper surface, a lower surface and an outer surrounding border, which lid in its four corners is provided with means arranged on the lower surface, which means comprise vertical surfaces intended to cooperate with the corresponding vertical surfaces of the recesses in the rim of the box.

The corresponding and cooperating vertical surfaces counteracts diagonally inwards and/or downwards directed forces, caused by heavy weights placed on top of the lid said forces tend to bend the inner area of the lid downwards and the four corners upwards. The lid will, hence, not be squeezed down into the box.

In various embodiments of the present invention, the lid can be provided with reinforcing twin-walled sections or profiles arranged at its four corners and/or perpendicularly arranged to at least two opposite sides. Reinforcing means such as webs, ribs, beams, girders or the like can, furthermore, be placed on or constitute an integrated part of the lower surface of the lid. Reinforcements as disclosed above result in a lid having a substantially increased carrying capacity. The lid can also while still being a part of the container according to the invention, be used with boxes having an upper plane-surfaced rim without matching recesses.

The lid can, in order to further improve the stability of a stack of containers and avoid lopsidednesses, be provided with guiding means arranged in the four corners of the upper surface. The guiding means are intended to define the location of a second container or the like stacked or piled upon the lid.

In a preferred embodiment, diagonally and perpendicularly arranged reinforcing profiles can, in order to further improve the absorption of inwards and downwards directed forces (as previously discussed) and thus improve the carrying capacity of the lid, be placed on or constitute an integrated part of the upper and/or the lower surface of the lid. The lid can, according to one embodiment, be provided with an outer surrounding downwards directed edge having a height of at least 20 mm, which edge interacts with an outer vertical surface surrounding the rim of the box. Such an outer edge contributes to prevent penetration of moisture and contaminations into the container as well as it further prevents the lid from being squeezed down into the box.

According to another embodiment of the invention, the lower surface of the lid is provided with step-like heels, spars or the like, said hells being placed in or constituting an integrated part of the four lid corners. The heels can be arranged inside a possible outer downwards directed edge. The vertical surfaces of the lid that cooperate with the corresponding vertical surfaces of the recesses in the upper rim of the box, can constitute integrated parts of the heels. The resulting container efficiently counteracts diagonally inwards and/or downwards directed forces affecting the lid.

The outer surrounding border of the lid and the upper rim of the box can be supplemented with mating means, mainly consisting of vertically arranged pegs, pins and/or the like with corresponding openings, holes and/or the like. Such mating means are suitably arranged in the four corners of the lid and in the recesses in the upper rim of the box.

BRIEF DESCRIPTION OF THE DRAWINGS

The invention is further illustrated by means of enclosed Figures wherein.

DETAILED DESCRIPTION OF THE DRAWINGS

Figure 1:
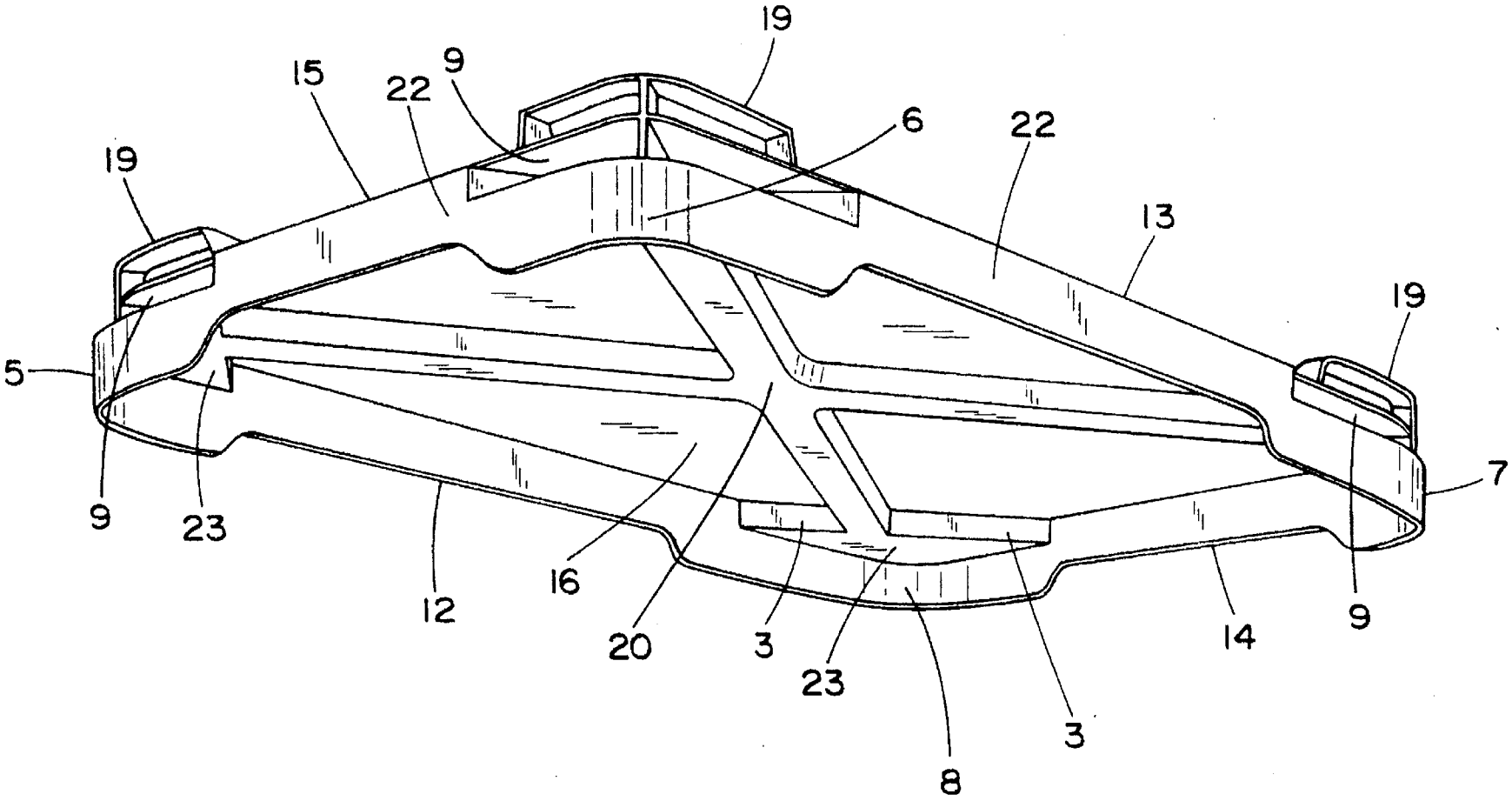
FIGS. 1, 2 and 3 show a bottom view of three embodiments of a lid to a container according to the present invention.

FIG. 1 shows from a bottom view of an embodiment of a plastic lid 1 (see FIGS. 7, 8 or 9) to a container according to the present invention. The lid 1 is at its four corners 5,6,7,8 provided with reinforcing twin-walled sections 9 and guiding means 19 arranged on the lid's 1 upper surface 18 (see FIG. 4). The guiding means 19 are intended to define the location of a second container 42 (see FIG. 8) or the like stacked or piled upon the lid 1, whereby the stability of a stack of containers is improved and lopsidednesses is avoided. Furthermore, the lid is provided with a surrounding downwards directed edge 22 for interaction with an outer corresponding and mainly vertical surface 36 surrounding the upper rim 21 (see FIGS. 5,6) of a box 2 (see FIG. 5). The lid 1 is on its lower surface 16 provided with step-like heels 23 having vertical surfaces 3, which vertical surfaces 3 are arranged inside the surrounding downwards directed edge 22. The vertical surfaces 3 are intended to cooperate with corresponding vertical surfaces 4 of recesses 28 (see FIGS. 5,6) in the upper rim 21 (see FIGS. 5,6) of a box (2). The heels 23 are connected to each other by means of reinforcing profiles 20.

Figure 2:
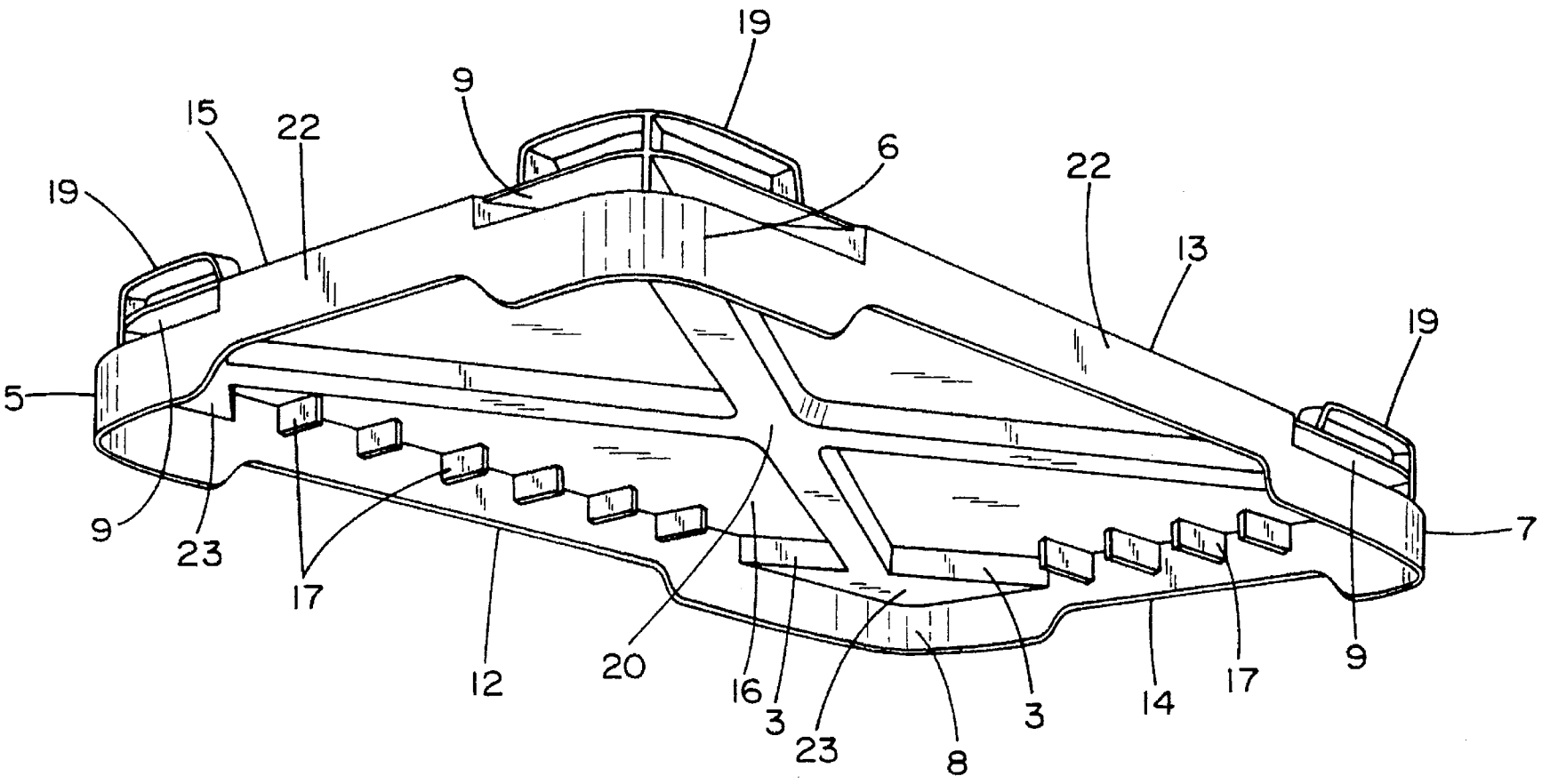

FIG. 2 shows a bottom view of an alternative embodiment of a plastic lid 1 according to the invention. The lid 1 is substantially the same as shown in FIG. 1 with the exception of supplemental reinforcing means 17. The reinforcing means 17 are on the lower surface 16 perpendicularly arranged to opposite sides 12,13 and 14,15, respectively.

Figure 3:
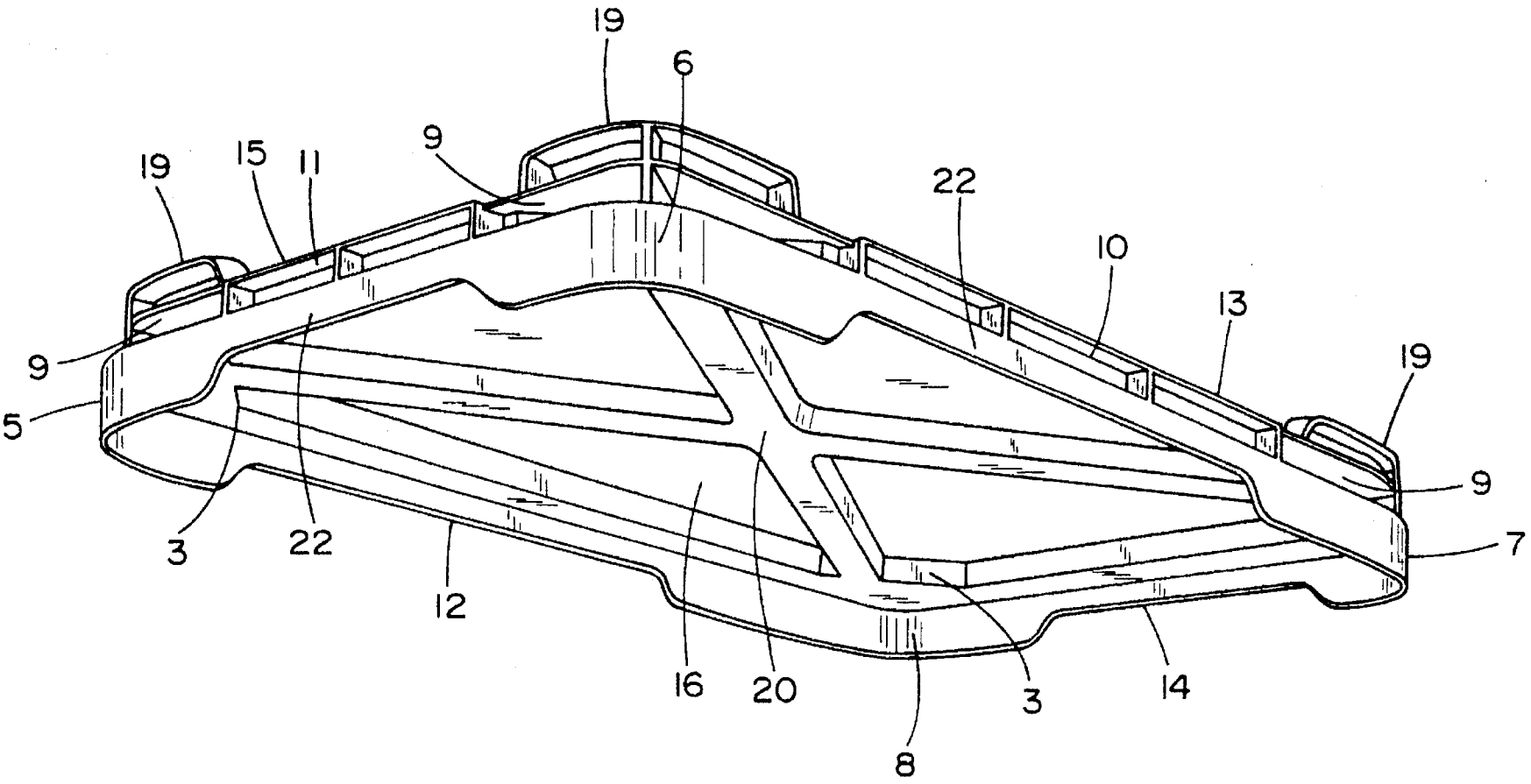
Figure 4:
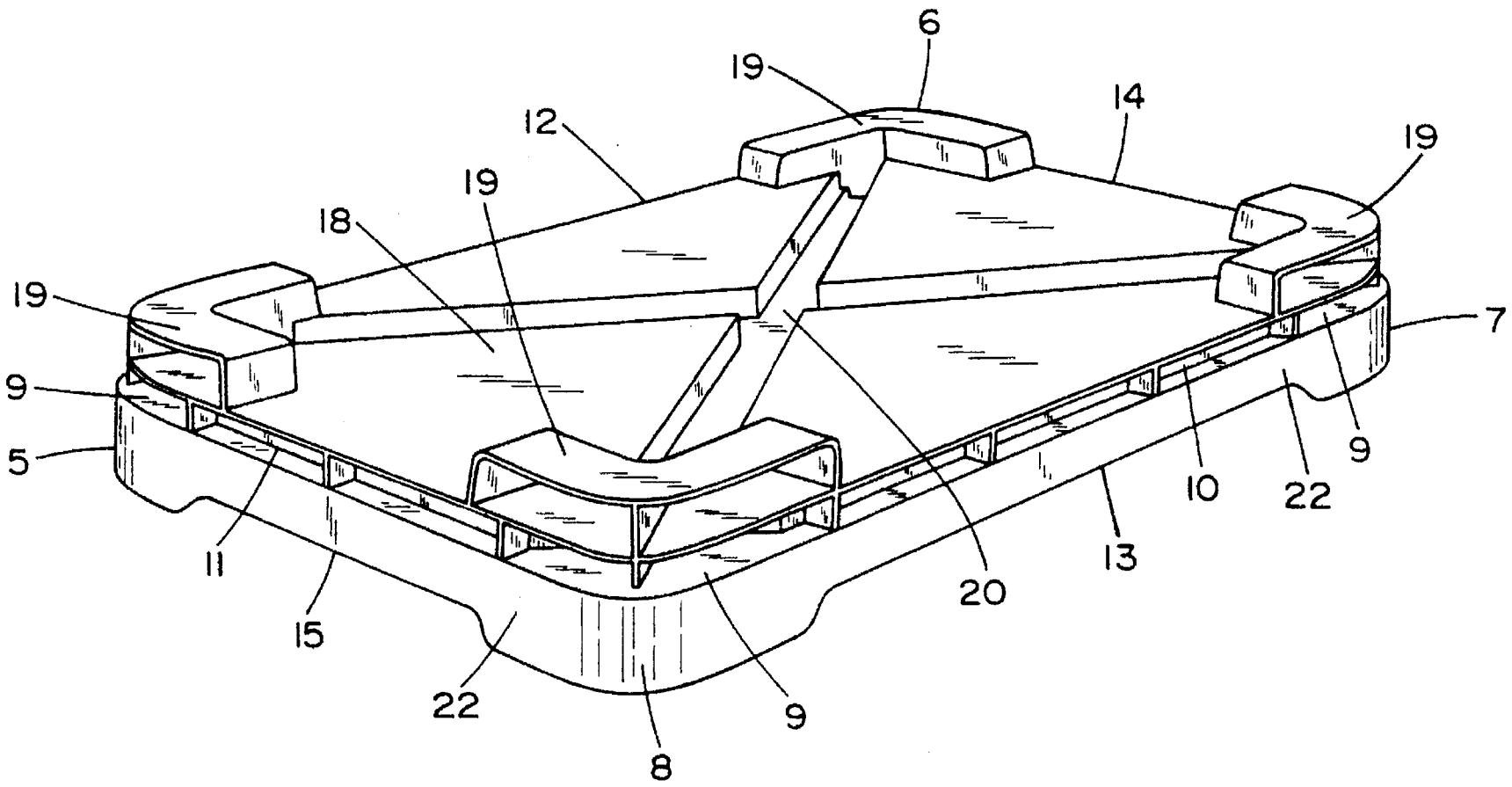
FIG. 4 shows a top view of the lid shown in FIG. 3.

FIGS. 3 and 4 show perspective views of a further embodiment of a plastic lid 1 according to the invention. The lid 1 is presented in a view from below (FIG. 3) and in a view from above (FIG. 4), respectively. The lid 1 is at its four corners 5,6,7,8 provided with twin-walled sections 9 and guiding means 19 are arranged on the upper surface 18 of the lid 1. The guiding means 19 are intended to define the location of a second container 42 (see FIG. 8) or the like stacked or piled upon the lid 1, whereby the stability of a stack of containers is improved and lopsidednesses is avoided. The lid 1 is, furthermore, provided with an outer surrounding downwards directed edge 22 intended to interact with an outer vertical surface 36 surrounding the upper rim 21 (see FIGS. 5,6) of a box (2). The lid 1 is also provided with diagonally arranged reinforcing profiles 20 and reinforcing twin-walled profiles 10,11 perpendicularly arranged to opposite sides 12,13 and 14,15, respectively.

Figure 5:
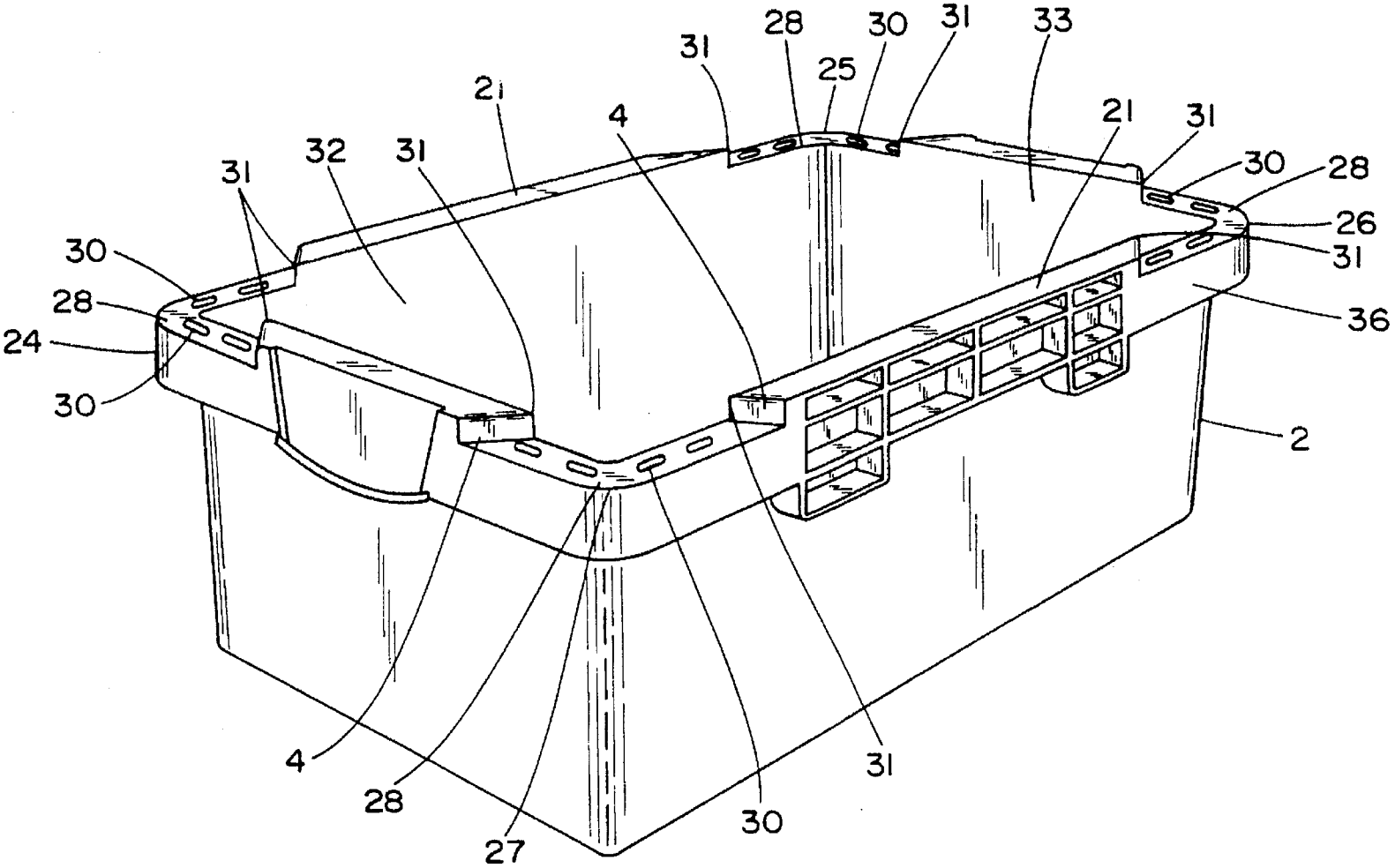
FIGS. 5 and 6 show perspective views of two embodiments of a box to a container according to the invention.

FIG. 5 shows a perspective view of an embodiment of a plastic box 2 according to the invention. The box 2 is provided with an upper rim 21 comprising recesses 28 having vertical surfaces 4 intended to cooperate with corresponding vertical surfaces 3 (FIGS. 1,2) of a lid 1. The recesses 28 are, furthermore, provided with four vertical holes 30 intended to mate with downwards directed pegs 29 (see FIG. 7) arranged on a lid 1. The vertical surfaces 4 are in this case arranged to respective wall 32,33,34,35 in such a way that an inner angle 31 of 45° is formed.

Figure 6:
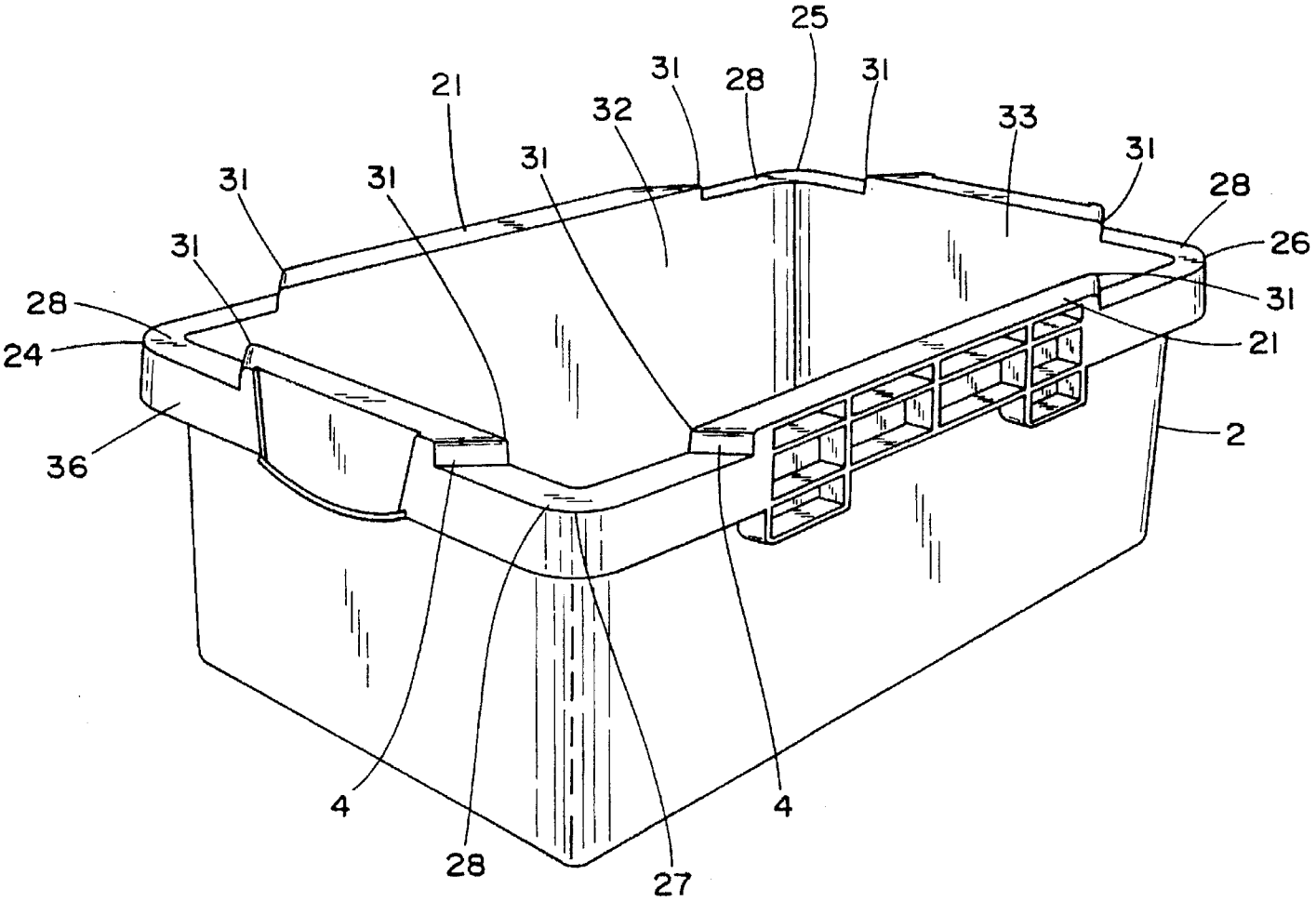

FIG. 6 shows a perspective view of an embodiment of a plastic box 2 according to the invention. The box 2 is substantially the same as shown in FIG. 5 with the exception of the vertical holes 30 in the recesses 28.

Figure 7B:
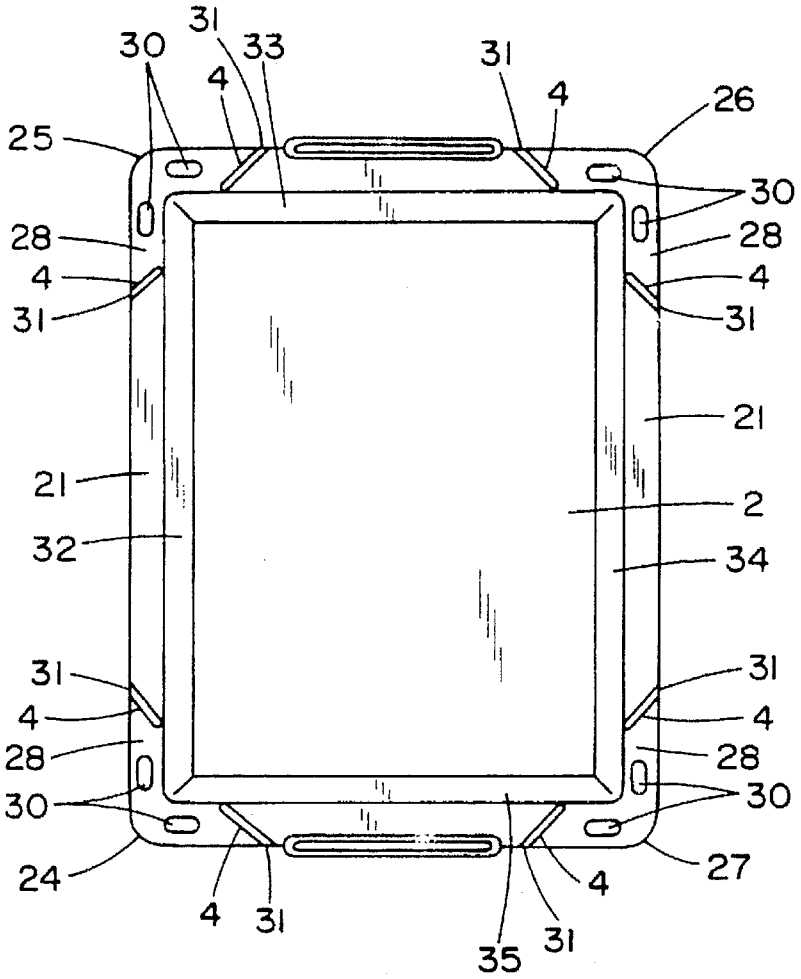
FIG. 7 shows a projection of an embodiment of a container according to the invention. The container consists of a lid and a box. The lid is shown in a view from below with a cross-sectional view of one of the corners and the box is shown in a view from above.
Figure 7A:
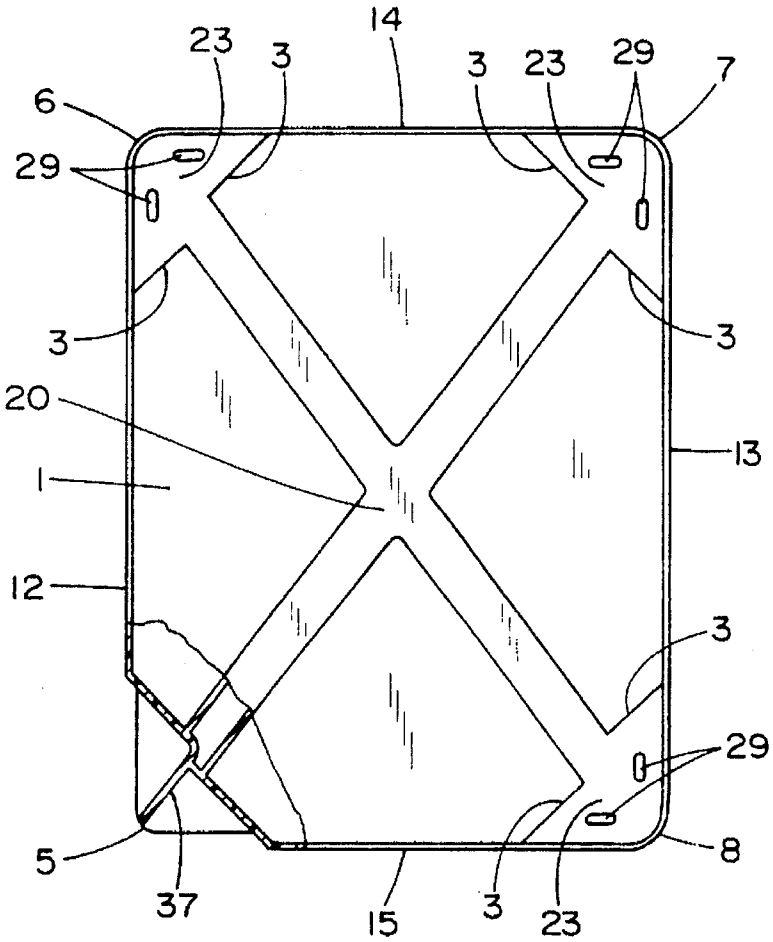

FIG. 7 shows a projection of an embodiment of a plastic container according to the invention. The container consists of a lid 1 and a box 2. The lid 1 is presented in a view from below with a cross-section of one of the corners 5 and the box 2 is presented in a view from above. The lid 1 is in its four corners 5,6,7,8 provided with heels 23 comprising vertical surfaces 3 designed for cooperation with the corresponding vertical surfaces 4 of the recesses 28 in the upper rim 21 of the box 2. Mating means 29,30 consisting of downwards directed pegs 29 and corresponding holes 30 are arranged in pairs. The pegs 29 constitute a part of the lid 1 heels 23 and the holes a part of the recesses 28 in the box 2 rim 21. The lid 1 heels 23 are, furthermore, connected to each other by means of diagonally arranged reinforcing profiles 20. A cross-section of one corner 5 of the lid 1 illustrates how an inner connection in the form of a rib 37 between the corner 5 and a reinforcing profile 20 is built up.

Figure 9:
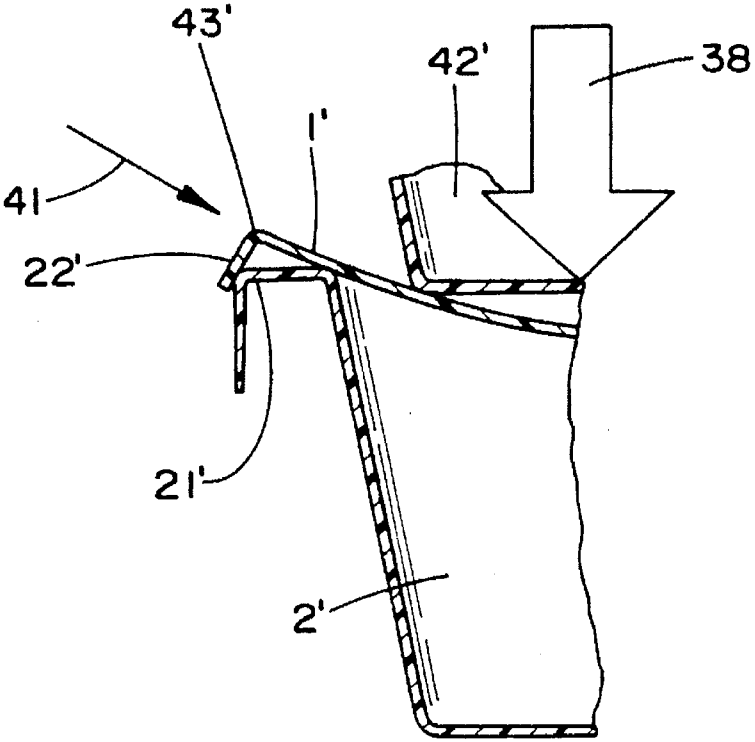
FIG. 9 PRIOR ART
FIGS. 8 and 9 how cross-sections of container hips, one according to an embodiment of the invention (FIG. 8) and one according to a prior art concept (FIG. 9). Both containers comprise a lid and a box and a second container has been stacked upon the lids. Arrows indicate a weight related strain, caused by the second container, and how this strain effects the lids.
Figure 8:
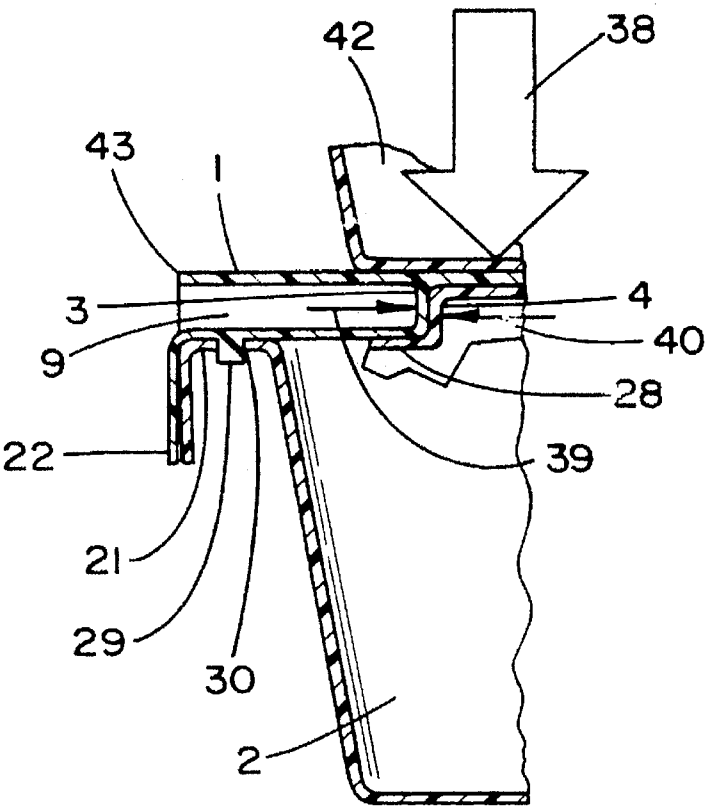

FIGS. 8 and 9 show cross-sections of two container hips, one according to an embodiment of the invention (FIG. 8) and one according to a prior art concept (FIG. 9). Both containers comprise a lid 1,1' having an outer surrounding downwards directed edge 22,22' and a box 2,2' having an upper rim 21, 21'. A second container 42,42' has been stacked upon the lid 1,1'. Arrows 38 indicate a weight related strain, caused by the second container 42,42', on the lid 1,1'. Arrows 39,40 (FIG. 8) and 41 (FIG. 9) indicate how and where forces, caused by the weight and strain, are absorbed by the lid 1,1'. The container (FIG. 8) according to the present invention is provided with corresponding and cooperating vertical surfaces 3,4 counteracting the strain and forces. The lid 1 is not bent, neither in its middle area nor at its outer end 43 (one of the lid 1 corners). The container according the prior art concept (FIG. 9) has no cooperating vertical surfaces and the lid 1' is bent downwards in its middle area and upwards at its outer end 43' (one of the lid 1' corners), whereby the lid 1' is being squeezed down into the box 2'. The load carrying capacity of the lid 1' is low and the risk of lopsidedness and/or overturning of a stack of containers is obvious.

I claim:

1. A plastic container, basket or the like comprising; in combination:

i) a box having a base, four walls extending upwards from the base with adjacent pairs of said walls being joined, each of said four walls having an upper edge wherein said adjacent pairs of said four walls are joined to form four upper corners, and an upper rim formed along said upper edges and said upper corners of said four walls, said upper rim having recesses located in said four upper corners, said recesses having vertical surfaces formed integral with said upper rim and being arranged so that an angle of less than 135° is formed between the vertical surfaces and the associated walls; and ii) a lid having four sides being positionable on said box, four lid corners forme dat the juncture of said four sides, an upper surface, a lower surface and an outer surrounding border, said four lid corners having vertical surfaces arranged on the lower surface of said lid that cooperate with the corresponding vertical surfaces of the recesses in the rim of the box, said four lid corners being provided with reinforcing twin-walled sections extending in parallel with said upper and lower lid surfaces, and guiding means extending above the upper surface of said lid being arranged in the four corners of the upper surface of the lid, said guiding means guiding a second container stacked or superimposed upon the lid into a predetermined orientation on said lid.

2. A container according to claim 1, wherein the lid comprises reinforcing twin-walled sections perpendicularly arranged on at least two opposite sides of said four sides.

3. A container according to claim 1, wherein reinforcing means including webs, ribs, beams, and girders are placed on the lower surface of the lid.

4. A container according to claim 3, wherein said reinforcing means are an integral part of the lower surface of the lid.

5. A container according to claim 1, wherein diagonally arranged reinforcing profiles are provided on the upper surface of the lid.

6. A container according to claim 5, wherein said reinforcing profiles are located on the lower surface of the lid.

7. A container according to claim 5, wherein said reinforcing profiles are located on both the upper surface and the lower surface of the lid.

8. A container according to any one of claims 5 or 6 or 7, wherein said reinforcing profiles are an integral part of the lid.

9. A container according to any one of claims 5 or 6 or 7, wherein said reinforcing profiles are perpendicularly arranged on said lid.

10. A container according to any one of claims 5 or 6 or 7, wherein said reinforcing profiles are both diagonally and perpendicularly arranged on said lid.

11. A container according to claim 1, wherein the lid is provided with an outer downward by directed encompassing edge having a height of at least 20 mm, and said edge interacts with an outer mainly vertical surface surrounding the rim of the box.

12. A container according to claim 1, wherein the lower surface of the lid is provided with step-like heels and spars which are located in the four corners of the lid.

13. A container according to claim 12, wherein the vertical surfaces of the lid constitute an integral part of the heels.

14. A container according to claim 12 wherein each said heel is an integral part of each of the four corners of the lid.

15. A container according to claim 1, wherein the outer of the lid and the upper rim of the box are provided with mating means (29,30) comprising vertically arranged pegs and pins and corresponding openings.

* * * * *